United States Patent [19]

Bernard et al.

[11] Patent Number: 4,853,998

[45] Date of Patent: Aug. 8, 1989

[54] SYSTEM FOR SPREADING AND DEPOSITING A SPANNING BEAM FROM A VEHICLE SUCH AS AN ARMORED VEHICLE OF THE ENGINEER CORPS FOR CLEARING AN OBSTACLE

[75] Inventors: Jean Bernard; Roger Brunet, both of La Seyne sur Mer, France

[73] Assignee: Constructions Industrielles de la Mediterranee (C.N.I.M.), France

[21] Appl. No.: 161,920

[22] Filed: Feb. 29, 1988

[30] Foreign Application Priority Data

Feb. 27, 1987 [FR] France ..... 87 02707

[51] Int. Cl.[4] ..... E01D 13/00

[52] U.S. Cl. ..... 14/2.4; 14/14

[58] Field of Search ..... 14/14, 2.4, 5, 1

[56] References Cited

U.S. PATENT DOCUMENTS

| | | | |
|---|---|---|---|
| 2,556,175 | 6/1951 | Frost | 14/2.4 |
| 3,845,514 | 11/1974 | Wagner | 14/2.4 |
| 4,534,079 | 8/1985 | Tucker | 14/14 |

FOREIGN PATENT DOCUMENTS

| | | | |
|---|---|---|---|
| 3007459 | 9/1981 | Fed. Rep. of Germany | 14/2.4 |
| 3205563 | 8/1983 | Fed. Rep. of Germany | 14/2.4 |
| 2608186 | 6/1988 | France | 14/2.4 |
| 779495 | 11/1980 | U.S.S.R. | 14/2.4 |

*Primary Examiner*—Jerome W. Massie, IV
*Assistant Examiner*—Matthew Smith
*Attorney, Agent, or Firm*—Steinberg & Raskin

[57] ABSTRACT

The present invention relates to a system for spreading and depositing a spanning beam from a vehicle wherein, in the transport position of the spanning beam on the vehicle, the outer extreme element of the spanning beam is pivotally supported and maintained at its free end by a mobile support device of the vehicle occupying a raised position while the inner extreme element of the spanning beam rests on the outer extreme element along same and wherein the spanning beam can be raised by winding of the working cable on a winch of the vehicle into a position where the inner extreme element is pivotally supported at its free end by the support device with concomitant release of the free end of the outer extreme element from the device.

18 Claims, 6 Drawing Sheets

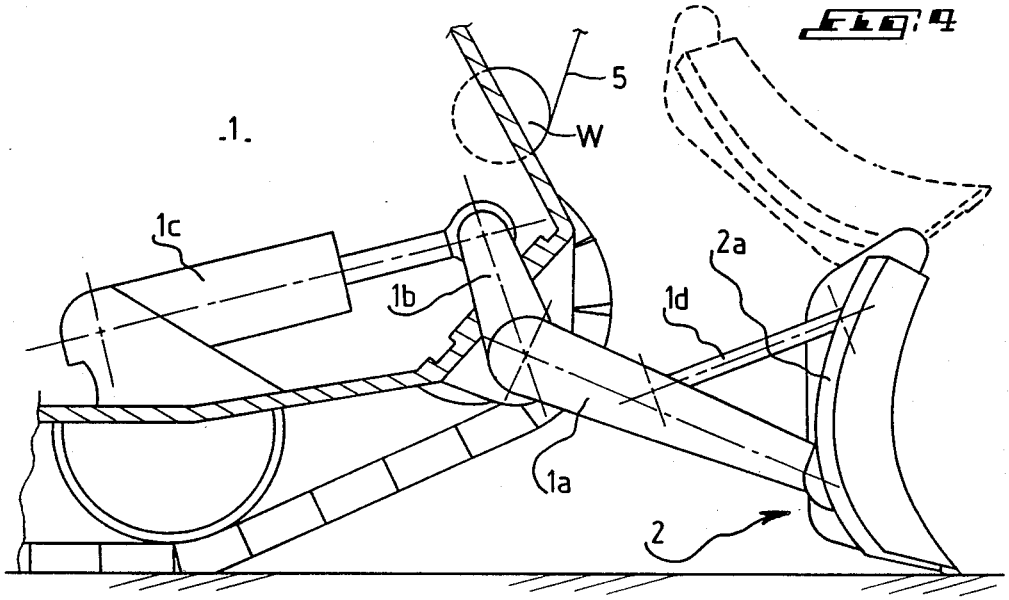
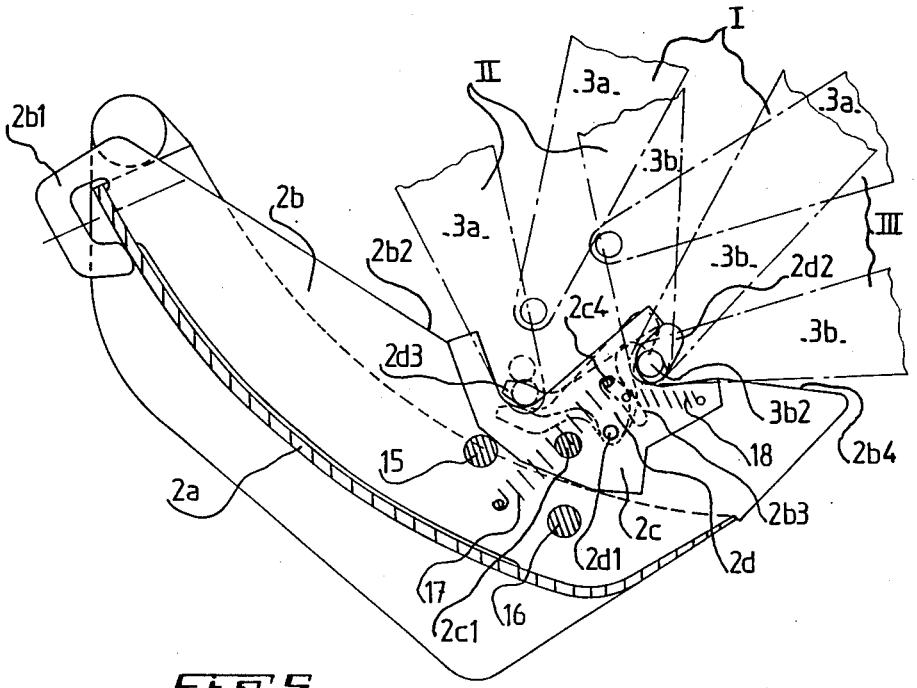
FIG. 5

4
3c
3a1
3a
14b
14a
X
X'
14
3b
3b1
III
4
III

2c

2d2
2b2
2b2
2d
2c5
2c4
17
17
2c1
2b4
2b4
2d1
2c6
2b3
18

SYSTEM FOR SPREADING AND DEPOSITING A SPANNING BEAM FROM A VEHICLE SUCH AS AN ARMORED VEHICLE OF THE ENGINEER CORPS FOR CLEARING AN OBSTACLE

BACKGROUND OF THE INVENTION

The present invention relates to a system for spreading and depositing a spanning beam from a vehicle such as an armoured vehicle of the Engineer Corps for clearing an obstacle formed for instance of a breach which may possibly be located in a NBC (Nuclear, Bacteriological, Chemical) contaminated area.

Spreading systems for such vertically pivoting spanning beams are known; in these systems, the spanning beam comprises at least two successive main elements, i.e. one inner extreme element and one outer extreme element which folds down against the inner extreme element along same, these elements being mounted in a hinged manner with respect to each other towards their adjacent ends through a hinge axis substantially perpendicular to the longitudinal axis of the spanning beam which is secured at least at one point of one of the inner and outer extreme elements to at least one working cable winding for example on at least one winch disposed on the vehicle.

However, these known systems comprise at least one control means formed for example of a hydraulic jack to ensure the pivoting of the outer extreme element with respect to the inner extreme element about the hinge axis. The drawback of such control means is that the spanning beam is burdened and especially that a great amount of additional energy is consumed.

SUMMARY OF THE INVENTION

It is an object of the present invention to eliminate the above drawbacks of the known systems by proposing a spreading and depositing system for a spanning beam which necessitates no control means and no additional source of energy.

For that purpose, the spreading and depositing system according to the invention is characterized in that, in a transport position of the spanning beam on the vehicle, the outer extreme element is supported and pivotally maintained at its free end by a mobile support device of the vehicle occupying a raised position while the inner extreme element rests along the outer extreme element; in that the spanning beam can be raised through winding of the working cable on the winch into a position where the inner extreme element is pivotally supported at its free end by the support device with concomitant releasing of the free end of the outer extreme element from the support device; in that the support device is then lowered towards a bearing position on the ground to cause the outer extreme element to move from the inner extreme element thus permitting the spreading of the spanning beam; and in that the working cable is unwound from the winch to lower and deposit the spanning beam over the breach.

According to a feature of the invention, the free end of the inner extreme element is released from the support device through backward movement of the vehicle with respect to the spanning beam.

According to another feature of the invention, the support device comprises at least one means for locking the free end of the outer extreme element to the said device, which locking device being unlocked when the free end of the inner extreme element is caused to rest on the support device in the raised position of the spanning beam.

According to still another feature of the invention, the locking means comprises a hook-forming part for holding on the support device an axis of the free end of the outer extreme element, disposed transversally to the longitudinal axis of the spanning beam, and which can pivot with respect to the support device in the unlocking direction against the restoring force of a resilient means such as a draw spring and a part, solid with the hook-forming part, forming a pivoting arm for the hook-forming part, which arm is actuated by an axis of the free end of the inner extreme element disposed transversally to the longitudinal axis of the spanning beam in the raised position of the spanning beam.

According to still another feature of the invention, the support device further comprises at least two parallel plates perpendicular to the ground, solid with a support element of the device and a bearing part for the respective end axes of the inner and the outer extreme elements, pivotally mounted between the two plates and which can co-operate alternately with two stops solid with the plates and limiting the range of pivoting of the bearing part between two extreme angular positions, one bearing position for the end axis of the outer extreme element in the transport position of the spanning beam and for the end axis of the inner extreme element in the raised and spreading positions of the spanning beam, and one release position for the end axis of the inner extreme element when the vehicle moves backwards.

According to still another feature of the invention, the bearing part comprises two bearing recesses with round bottom respectively for the two end axes of the inner and outer extreme elements, and the hook-forming part of the locking means co-operates with the bearing recess of the end axis of the outer extreme element and with a front edge of each of the parallel plates to lock the axis in the transport position of the spanning beam.

According to still another feature of the invention, the locking means, made in one piece with the pivoting arm opposite to the hook-forming part, is pivotally mounted inside the bearing part, which the pivoting arm projects into the bearing recess of the end axis of the inner extreme element in the transport position of the spanning beam.

BRIEF DESCRIPTION OF THE DRAWINGS

For a fuller understanding of the invention, reference is made to the following description, taken in connection with the accompanying drawings, in which:

FIG. 4 represents in detail the control mechanism of the support device of the spanning beam, which is located at the front of the vehicle;

FIG. 5 is an enlarged view of the support device of the beam in the encircled part shown at V for example in FIG. 1B and showing several positions of the ends of the two main elements forming the spanning beam;

DESCRIPTION OF THE PREFERRED EMBODIMENTS

Figure 1A:
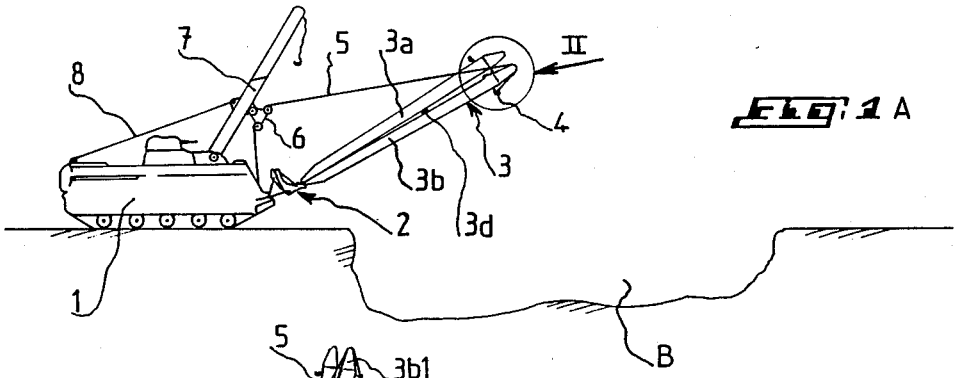
FIGS. 1A–1H represent a vehicle equipped with the system of the invention in various positions for spreading and depositing a spanning beam over a breach.

Referring to FIGS. 1A to 1H, the reference sign 1 designates a vehicle, in particular an armoured vehicle of the Engineer Corps, comprising a support device 2 for a spanning beam 3 fixed at least one point 4 to at least one working cable 5 winding for example on at least one winch disposed on the vehicle 1. The working cable 5 is linked to the winch through a lifting beam with pulleys 6 hinged to an arm 7 of the vehicle 1, which arm is maintained on the vehicle by a bracing 8.

The support device 2 comprises one actual support element 2*a* formed in the present case of a hollow blade forming part similar to that of a bulldozer. The support device 2 is mounted in a movable manner with respect to the vehicle 1 between a raised position represented in dotted line in FIG. 4 and a position lowered down on the ground. For that purpose, a main arm 1*a* is pivotally mounted at one of its ends on the vehicle 1 and is solid at its other end with the lower part of the support device 2. The main arm 1*a* is solid with a transmission arm 1*b*, the free end of which is linked to the free end of a stem of a control means formed e.g. by a hydraulic jack 1*c* disposed on the vehicle. A strengthening arm 1*d* is located between the middle part of the main arm 1*a* and the upper part of the support device 2. Such a blade raising and lowering mechanism is already known per se so that there is no need to describe it in more detail.

Figure 8:
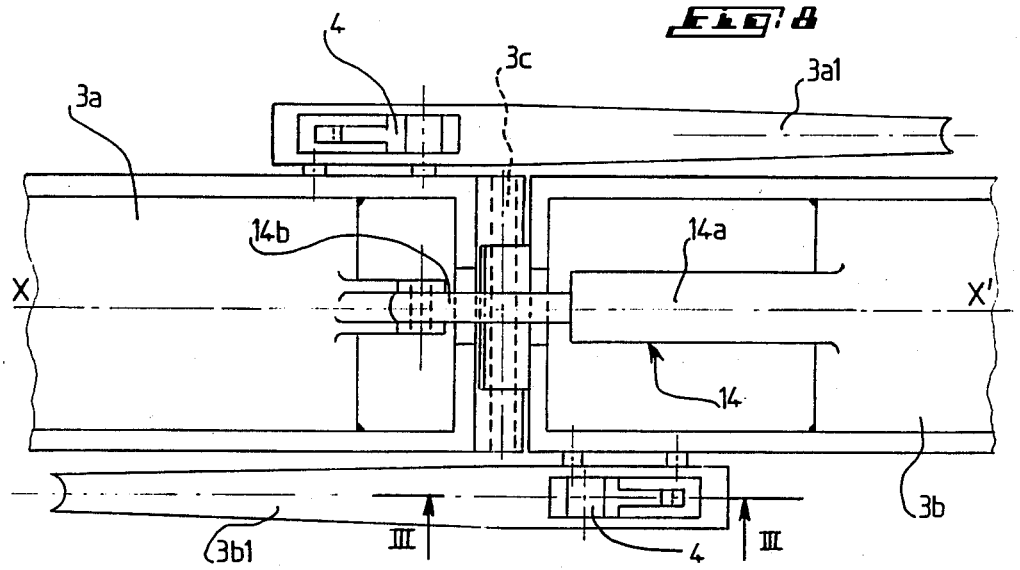
FIG. 8 is a top view along arrow VIII of FIG. 3.
Figure 9:
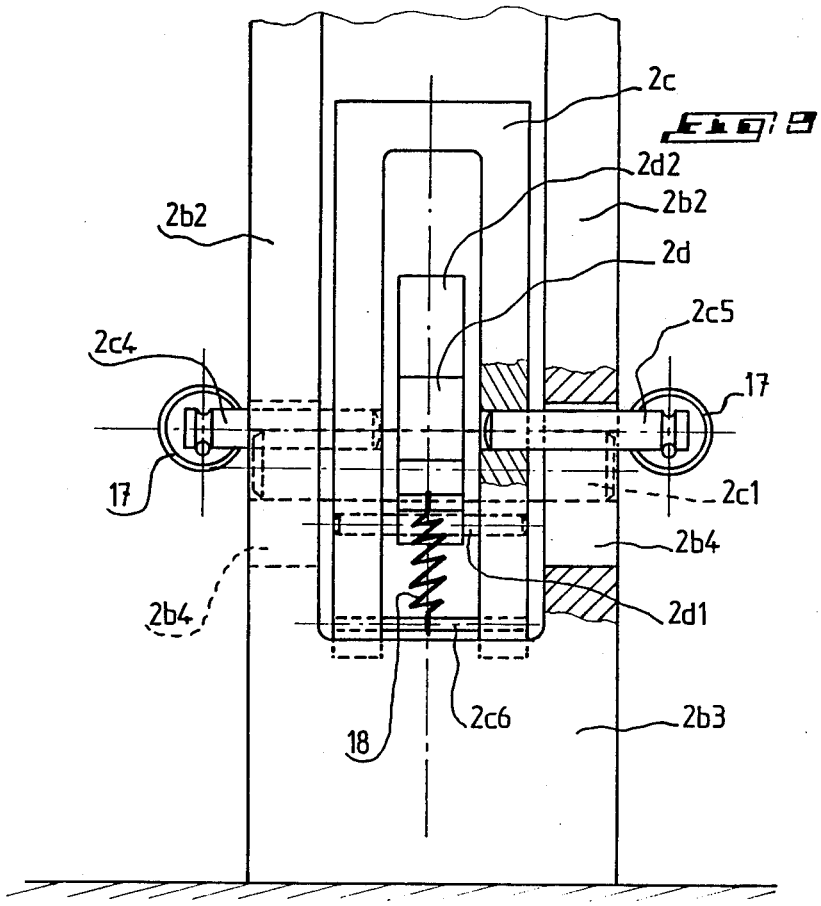
FIG. 9 is a view along arrow IX of FIG. 7 with partial cross-section.

The spanning beam 3 comprises at least two successive main elements, one inner extreme element 3*a* and one outer extreme element 3*b*, mounted in hinged relationship with respect to each other towards their adjacent ends through a hinge axis 3*c* substantially perpendicular to the longitudinal axis X—X' of the spanning beam (see FIG. 8).

The principle of operation of the system according to the invention will now be described with reference to FIGS. 1A to 1H.

The working cable 5 connected in the present case to the outer extreme element 3*b* of the spanning beam 3 while moving on this element as will be described in more detail later, and on the pulleys of lifting beam 6 which are secured on arm 7 of vehicle 1, maintains the spanning beam 3 on the support device 2 in a transport configuration of the spanning beam as shown in FIG. 1A. In this transport position of the spanning beam, the outer extreme element 3*b* is supported and maintained in a pivoting manner at its free end by the support device 2 which occupies the raised position while the inner extreme element 3*a* rests on the outer extreme element 3*b* along same through a bumper-forming device schematically represented by reference sign 3*d* and solid e.g. with element 3*b*. It is to be noted that the free end of element 3*a* is totally released in the transport position, i.e. this element does not rest by any way on the support device 2. Moreover, a locking means, which will be described with further detail later, mounted on the support device 2, keeps the free end of element 3*b* on the support device 2. Thus, the spanning beam 3 is transported by vehicle 1 which positions itself on the chosen launching area represented in the present case by a breach B.

Figure 1B:
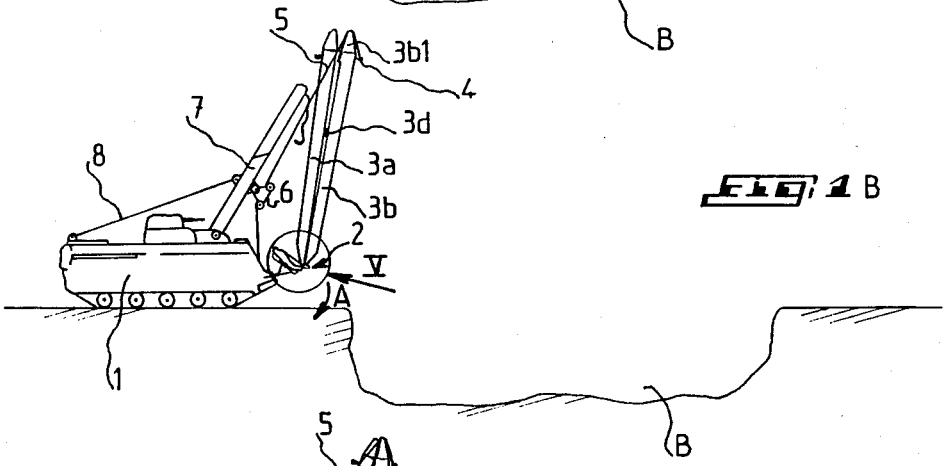
Figure 1C:
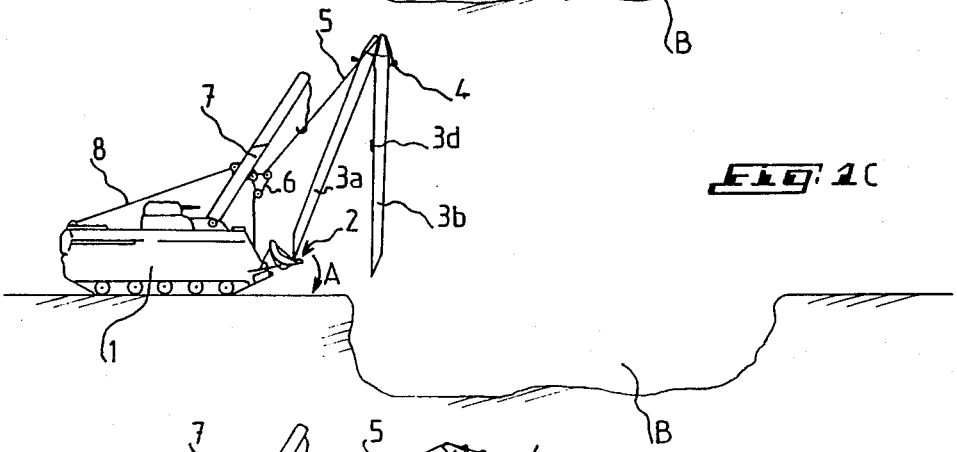
Figure 1D:
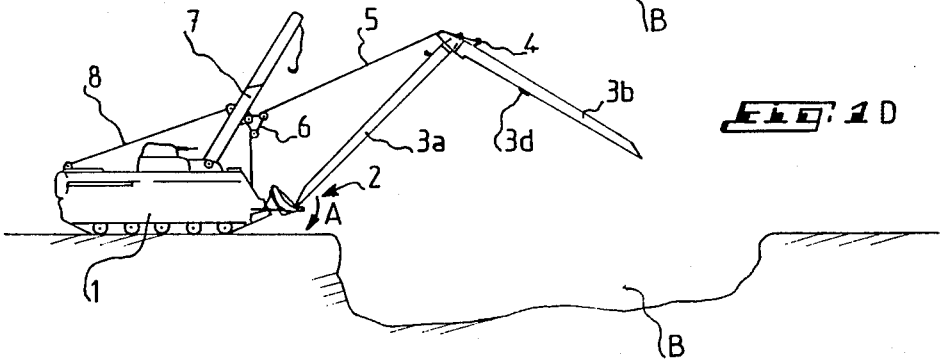

Once the vehicle is positioned, the spanning beam 3 is raised through winding of the working cable 5 on the winch of to vehicle up the position shown in FIG. 1B, close to the vertical position, and in which the inner extreme element 3*a* is supported in a pivoting manner at its free end by the support device 2 with concomitant release of the free end of the outer extreme element 3*b* from the support device. In the raised position of FIG. 1B, the support device 2 still occupies the raised position of FIG. 1A. The raising of the spanning beam makes it possible to pass from the carrying of the outer extreme element 3*b* to the carrying of the inner extreme element 3*a*, the change of bearing point of the spanning beam on support 2 permitting the release of the lower part of outer extreme element 3*b* by actuating the locking means of the free end of this element as will be described later. In the raised position of FIG. 1B, the center of gravity of the spanning beam is substantially located at the bearing end of the inner extreme element on the device so that the outer extreme element is folded down against the inner extreme element.

Figure 1E:
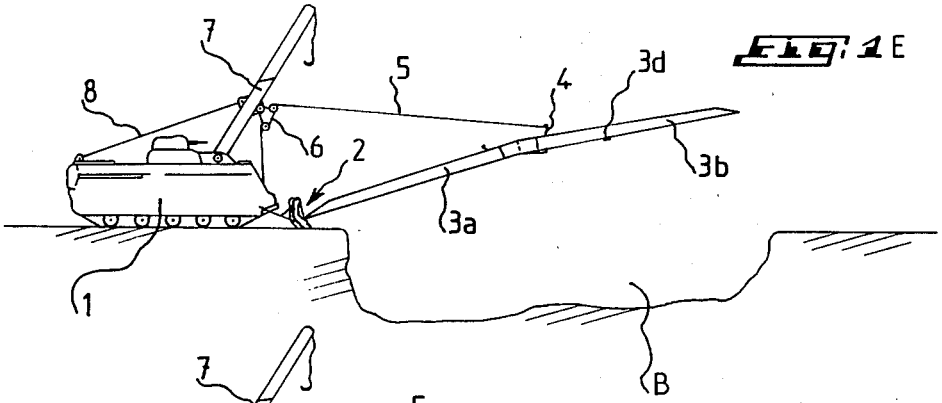

The support device 2 is then lowered as shown by arrow A so as to lower the bearing point of the inner extreme element 3*a* on the device 2 and to separate the outer extreme element 3*b* from the inner extreme element 3*a* and thus to permit a spreading of the spanning beam, as shown in FIG. 1E. During the lowering of the support device 2, the working cable 5 moves round a side extension 3*b*1 of element 3*b* so that the latter acts as a lever arm about the hinge axis 3*c* to facilitate the spacing of the outer extreme element 3*b* from the inner extreme element 3*a*. It is to be noted that from the raised position of the spanning beam shown in FIG. 1B to the spread position of same shown in FIG. 1E, the length of the working cable 5 remains constant so that the lowering of the support device 2 alone, taking into account the moving of the cable round the extension 3*b*1 and its point of attachment 4, ensures the spreading of spanning beam 3.

Figure 1F:
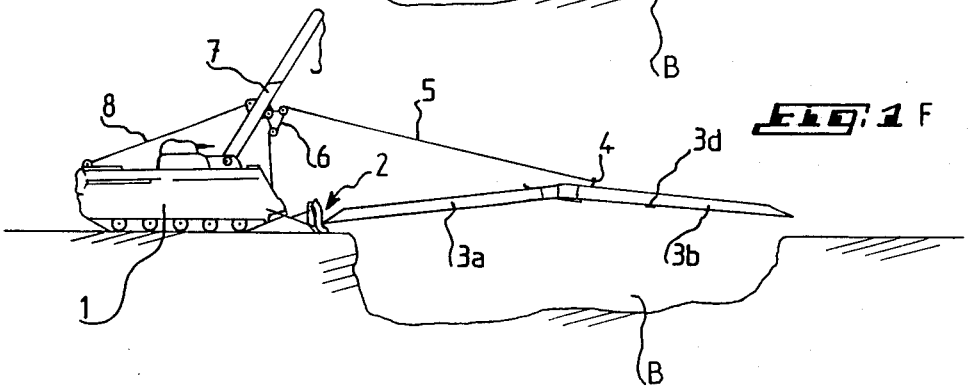

From the spreading position of the spanning beam shown in FIG. 1E in which the support device 2 rests on the ground, the working cable 5 is unwound from the winch to lower and deposit the spanning beam 3 over the breach B as shown in FIG. 1F.

Figure 1G:
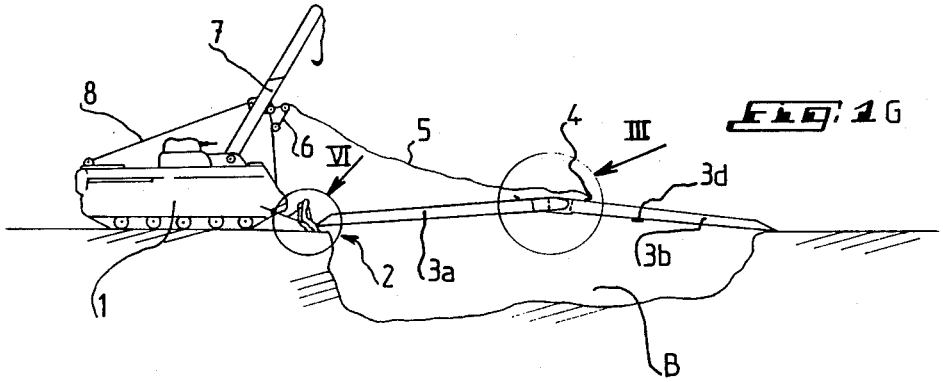

Once the spanning beam deposited over the breach, the working cable 5 is unwound more from the winch to slacken it and to release it automatically from its point of attachment on outer extreme element 3*b* in the way which will be described later (see FIG. 1G).

Figure 1H:
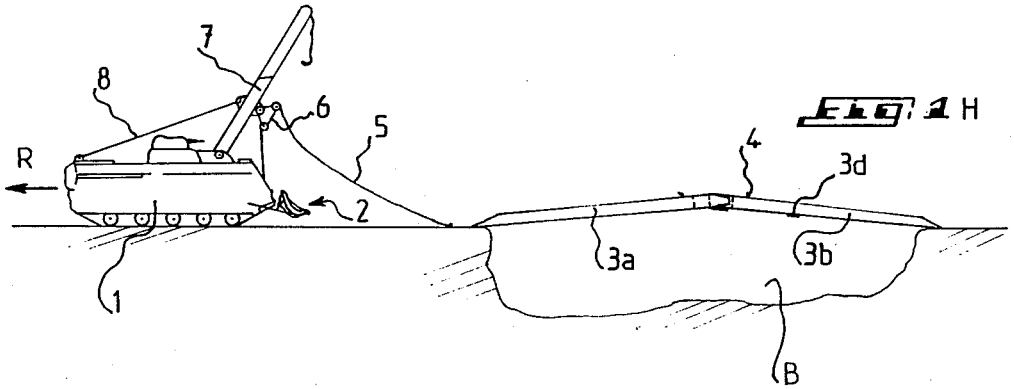

The vehicle 1 is then moved backwards with respect to the spanning beam 3 as shown by arrow R in FIG. 1H to release the end of the inner extreme element 3*a* of the spanning beam from the device 2 and to withdraw the working cable 5 from the spanning beam.

After use of the spanning beam, the spanning beam is folded up as follows.

The vehicle 1 comes closer to the spanning beam, the support device 2 being in the lowered position so that it raises the end of the inner extreme element 3*a* and positions it at its bearing point on device 2. The working cable 5 is then fixed to a point of anchoring or attachment of the inner extreme element 3*a* located near its end opposite to its supporting point on device 2. The cable 5 is then wound on the winch so as to raise the spanning beam towards the approximately vertical position shown in FIG. 1B. During this phase of raising of the spanning beam, the outer extreme element 3b folds down towards and against the inner extreme element and the support device 2 passes from the lowered position to the raised position. In the raised position of FIG. 1B, the center of gravity of the spanning beam is substantially located at the bearing end of the inner extreme element on device 2 so that the outer extreme element 3b is well folded down against the inner extreme element. The working cable 5 is then unwound from the winch to bring the spanning beam into an angular position corresponding to that shown in FIG. 1A (for example of about 30° with respect to the ground). Of course, in this position, the outer extreme element 3b is locked and maintained on the support device 2 and the other element 3a rests on element 3b. A trailer (not shown) is then caused to come close to the spanning beam along its longitudinal axis. The working cable 5 is unwound again to bring the end of the spanning beam opposite to its end supported on device 2 on the trailer according to such a configuration that the bearing point of the inner extreme element on device 2 is at a somewhat greater height than that of the opposite end of the spanning beam. The support device 2 is then lowered so as to totally deposit the spanning beam on the trailer and the unlocking means is manually actuated to release the free end of the inner extreme element 3b from the device 2.

The recovery of the spanning beam from the trailer on the support device 2 is performed by bringing the trailer near to the device so that the free end of the outer extreme element 3b is caused to face the locking means of the device and is manually locked in it. The working cable 5 which is partially wound round the extension 3b1 and fastened to the point of attachment 4, is then wound on the winch so as to raise the spanning beam about its hinge point on device 2 and to put it in the transport position shown in FIG. 1A. The spanning beam is then ready for a new spreading operation over another breach.

Figure 2:
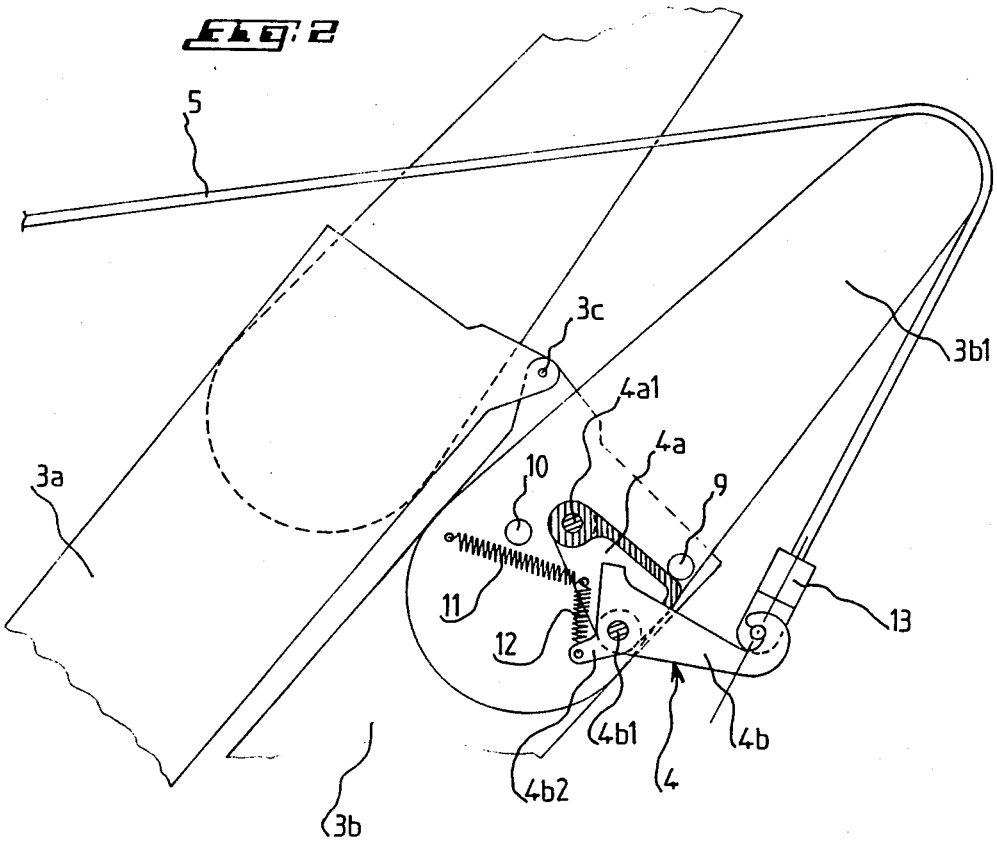
FIG. 2 is an enlarged view of the encircled part shown at II in FIG. 1A.
Figure 3:
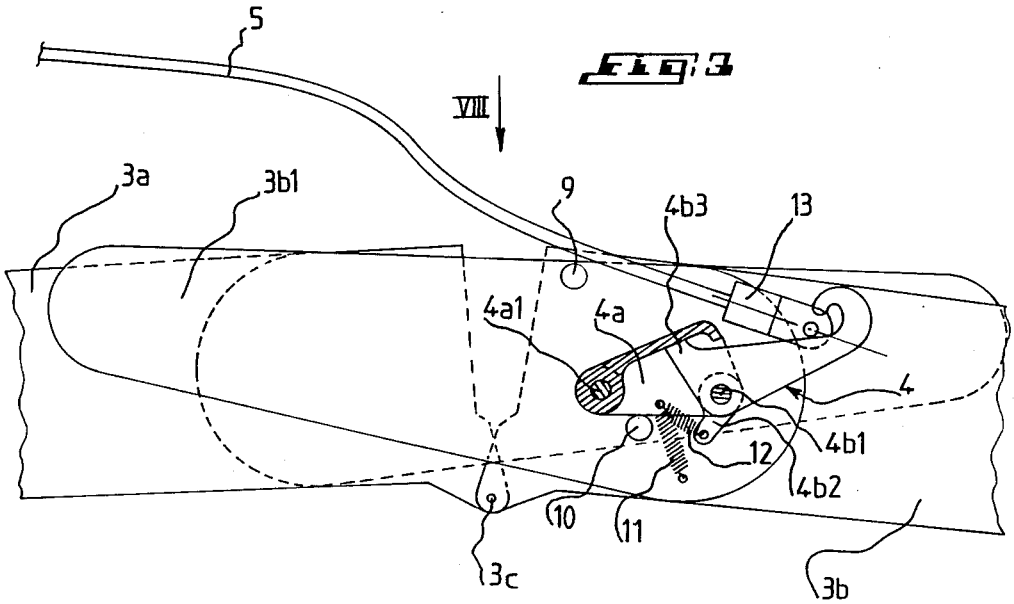
FIG. 3 is an enlarged view of the encircled part shown at III in FIG. 1G.

Referring to FIGS. 2, 3 and 8, there will now be described in detail the structure and the operation of the point of attachment of the end of cable 5 on the outer extreme element 3b which makes it possible to automatically unhook the cable in the spread position of the spanning beam. The point of attachment 4 is formed of a support plate 4a for a hook-forming part 4b, which can co-operate alternately with two stops 9 and 10 solid with the extension 3b1 of the outer extreme element to limit the range of pivoting of the plate 4a about an axis 4a1 solid with the extension 3b1 between two extreme angular positions respectively of hooking of the working cable 5 as shown in FIG. 2 and of unhooking of the cable as shown in FIG. 3. A resilient restoring means such for example as a draw spring 11 is connected at one of its ends to the support plate 4a and at its other end to the extension 3b1. This spring tends to draw the support plate 4a back against the stop 10. The hook-forming piece 4b is pivotally mounted about an axis 4b1 solid with the support plate 4a and comprises a projecting lug 4b2 to which is connected the end of a resilient restoring means 12 formed also for example of a spring, which other end is connected to the common point of attachment of the end of spring 11 on plate 4a. The spring 12 tends to draw the hook-forming part 4b back clockwise with respect to plate 4a. The lateral lever arm forming extension 3b1 of the outer extreme element 3b is laterally solid with the latter, near its hinge axis with element 3a as clearly shown in FIG. 8, and spreads substantially in a direction parallel to the longitudinal axis of element 3b beyond axis 3c. The assembly formed of the support plate 4a and the hook-forming part 4b is housed inside the extension 3b1 near the end of the outer extreme element 3b close to axis 3c. The arm 3b1 comprises at its free, rounded end, a guiding path for the working cable 5. This cable is connected to the hook of part 4b through a clevis 13.

The inner extreme element 3a comprises also, laterally solid with it, and near the axis 3c, a lateral lever arm-forming extension 3a1 (FIG. 8) identical to the arm 3b1 and which extension 3a1 includes a point of attachment 4, the structure and the operation of which are identical to those of the point of attachment 4 shown in FIG. 2. The arm 3a1 spreads substantially in a parallel direction to the longitudinal axis of said element beyond axis 3c.

In the transport position of the spanning beam, shown in FIG. 2, the cable 5 moves round the extreme periphery of arm 3b1 and exerts a traction on the hook-forming part 4b through the clevis 13. The hook-forming part 4b, against the restoring action of spring 12, is caused to rest against a corresponding part of the support plate 4a, which is urged against stop 9 against the restoring action of spring 11. The position of the point of attachment 4 with respect to the extension 3b1 shown in FIG. 2 is maintained during the phases of raising and of spreading of the spanning beam. When the spanning beam rests on the breach B as shown in FIG. 1G, the winch is actuated so as to slacken the cable 5. In this state, as shown in FIG. 3, the spring 11 draws the support plate 4a back against stop 10 and spring 12 draws the hook-forming part 4b back clockwise with respect to plate 4a towards a position where the clevis 13 of cable 5 disengages through gravity from the hook of part 4b. The range of pivoting of part 4b with respect to plate 4a is limited by a heel 4b3 which is caused to rest on a corresponding part of plate 4a.

FIG. 8 shows in addition a damping device 14 formed for example of a hydraulic jack mounted along axis X—X' and the body 14a of which is solid with the outer extreme element 3b and the stem 14b, passing over axis 3c, is solid at its free end with the inner extreme element 3a. The damping device 14 has as an effect to delay the effect of acceleration of the opening movement of spanning beam 3 appearing before the complete spreading of the spanning beam.

The support device 2 will now be described in detail with reference to FIGS. 5–7 and 9.

This device comprises at least two parallel plates 2b solid with the blade 2a and located respectively in a transversal plane with respect to blade 2a and thus perpendicular to the ground. Each plate 2b has an arc-shaped part conjugate to the hollow part of blade 2a in order to rest on this one and includes at its upper end a bent part 2b1 enclosing the upper part of blade 2a. A fixing means, such for example as a screw shown in dot-and dash-line, can be provided at the upper part of blade 2a to improve the fixing of plate 2b on blade 2a. The plates 2b further include respectively two front edges 2b2 connected at the lower part of the plates to a nose-forming part 2b3 to form a guiding path for the end of the inner extreme element 3b of the spanning beam as will be explained later.

Figure 7:
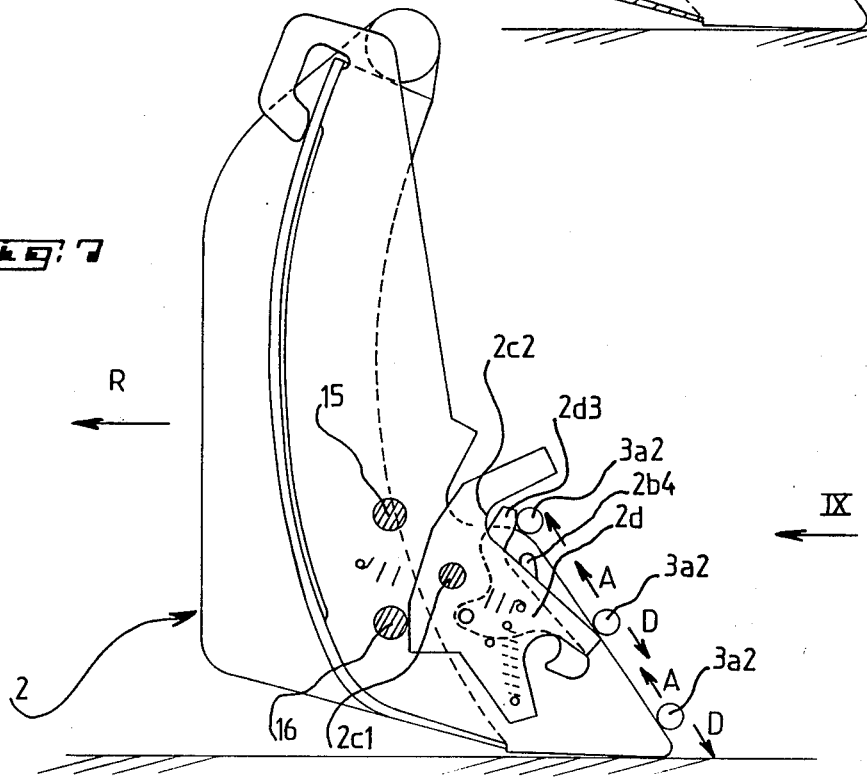
FIG. 7 represents the support device in a position which permits the spanning beam to be released from it.

The support device 2 further comprises a bearing part 2c for the respective ends of the extreme elements 3a and 3b, pivotally mounted between the two plates 2b about an axis 2c1 disposed transversally between the two plates 2b and which can alternately co-operate with two stops 15 and 16 solid with the plates and limiting the range of pivoting of the bearing part between two extreme angular positions, i.e. one bearing position for the end of the outer extreme element 3b in the transport position of the spanning beam shown at I in FIG. 5 and for the end of the inner extreme element 3a in the raised (shown at II in FIG. 5) and in the spreading position of the spanning beam, and one releasing position for the end of the inner extreme element 3a when the vehicle 1 moves backwards as shown in FIG. 7.

The bearing part 2c comprises two recesses 2c2 and 2c3 with rounded bottom for bearing respectively two respective end axes 3a2 and 3b2 of the inner and outer extreme elements 3a and 3b. The axes 3a2 and 3b2 are disposed transversally to the longitudinal axis of the spanning beam respectively at the ends of the inner extreme element and of the outer extreme element. The bearing part 2c further comprises two axes 2c4 and 2c5 transversally projecting from both sides of the bearing part 2c and to which respective ends is attached the end of a draw spring 17 which maintains the bearing part 2c in one or in the other of its extreme angular positions. As better shown in FIG. 9, each of the axes 2c4 and 2c5 passes through a bean-shaped oblong hole 2b4 formed through each of plates 2b. When the bearing part 2c moves between the two aforesaid extreme angular positions, the axes 2c4 and 2c5 move within their corresponding oblong hole.

The support device 2 comprises also a means 2d for locking the end axis 3b2 of the outer extreme element 3b on said device, which means is pivotally mounted inside the bearing part 2c about an axis 2d1 mounted transversally inside the bearing part 2c. The locking means 2d, made in a single piece, comprises a hook-forming part 2d2 for holding the axis 3b2 back in the transport position of the spanning beam as well as in the position of the spanning beam on the trailer, schematically shown at III in FIG. 5, this hook-forming part projecting in these positions from the recess 2c3 to maintain the axis 3b2 in a holding space partly defined by the recess 2c3 and the front edges of plates 2b. The locking means 2d further comprises a pivoting arm-forming part 2d3 of the hook-forming part, opposite to the latter and projecting from the recess 2c2 of the bearing part 2c in the transport position of the spanning beam. A resilient means, such for example as a draw spring 18, connected at its free ends respectively to a fixing point solid with the locking means and to a fixing axis 2c6 solid with the bearing part 2c, draws the locking means 2d back into its locking position.

Preferably, two pairs of parallel plates 2b, each comprising the assembly formed by the bearing part 2c and the locking means 2d, are mounted on blade 2a symmetrically to the longitudinal axis of vehicle 1 which coincides with the axis X—X' of the spanning beam mounted on the vehicle.

The operation of the support device 2, which already follows partly from the preceding explanations, will now be described in more detail.

Figure 6:
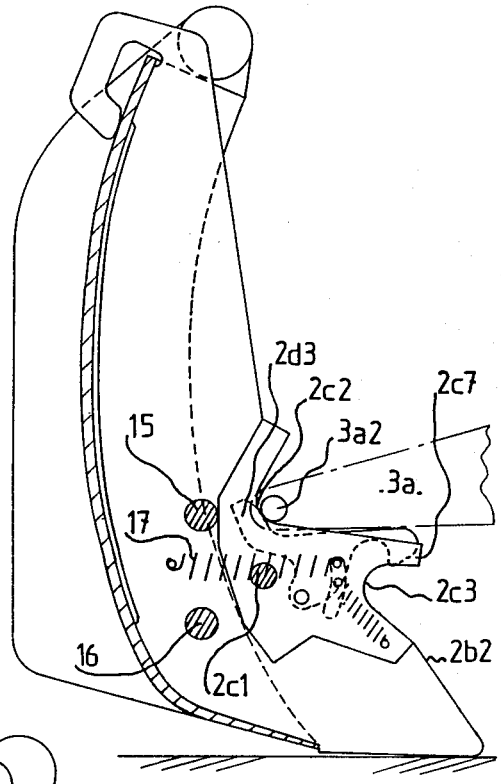
FIG. 6 is an enlarged view of the encircled part shown at VI in FIG. 1G.

When the support device 2 is in the raised transport position of the spanning beam, the end axis 3b2 of element 3b is maintained on the device 2 through the hook-forming part 2d2 of the locking means 2d. When the spanning beam is raised towards the approximately vertical position, the end axis 3a2 of the element 3a, by contacting the arm 2d3, causes the hook-forming part to pivot in the unlocking direction shown in dotted line in FIG. 5, thus releasing the end axis 3b2 of element 3b. Of course, the end axis 3a2 of element 3a rests inside the recess 2c2 of the bearing part 2c to ensure the pivoting of the spanning beam during the spreading. FIG. 6 shows its extreme part of inner element 3a resting through its end axis 3a2 in the recess 2c2 when the spanning beam is spread and deposited as shown in FIG. 1G. From this position, the vehicle 1 is caused to move backwards in the direction of arrow R as shown in FIG. 7, so as to move the support device 2 in the same direction and to cause the end of the inner element 3a to move by gravity first along a leg 2c7 of part 2c defined between the two recesses 2c2 and 2c3 to provoke the pivoting of part 2c against stop 16. Then, the edges 2b2 of plates 2b and the nose 2b3 form a guiding path for the end axis 3a2 of element 3a in the descending direction, as shown by arrows D so as to deposit the end of element 3a and thus the spanning beam on the launching area. After use of the spanning beam, the recovery of element 3a is carried out by causing the nose-forming part of plates 2b to move towards the end axis 3a2 to put it again on the nose and on the guiding path-forming edges 2b2 and to bring it into its bearing recess 2c2 as shown by arrows A in FIG. 7. Before entering the recess 2c2, the end axis 3a2 exerts a pivoting action on bearing part 2c towards the extreme angular position defined by stop 15. The device returns then into the position shown in FIG. 6. The beam is then raised as already described before, in order to be thereafter put on the trailer. The unlocking of the end axis 3b2 of element 3b before the beam is totally put on the trailer is ensured by manually exerting a pressure on the pivoting arm 2d3 of the hook-forming part 2d2.

Of course, instead of recovering and raising the spanning beam when the vehicle 1 is in the position shown in FIG. 1H, it is also possible to recover the spanning beam when the vehicle is on the other side of the breach, the outer extreme element becoming then the inner extreme element while the inner extreme element becomes the outer extreme element. Moreover, the spreading of the spanning beam may be carried out from the vehicle 1 located on the side of the breach B opposite to the side where the vehicle is located, as shown in FIG. 1A. In this case, the hook-forming assembly 4 of arm 3a1 will act in the same way as the hook-forming assembly 4 of arm 3b1. Moreover, it is to be noted that the point of attachment which permits the fixing of the working cable 5 in order to raise the spanning beam may be the hook-forming assembly 4 of the inner extreme element.

Besides, the mechanism shown in FIG. 4 has been given by way of example, it being understood that other mechanisms performing identical functions to the described mechanism may be used. Finally, although the present invention has been described with reference to an armoured vehicle of the Engineer Corps, it nevertheless also applies to other vehicles having the same functions.

What is claimed is:

1. A system for spreading and depositing a spanning beam from a vehicle for clearing a breach, the spanning beam pivoting vertically and occupying a transport position on the vehicle and having two successive main elements, one inner extreme element and one outer extreme element folded down against the inner extreme element along the same, mounted in hinged relationship with respect to each other towards their adjacent ends through a hinge axis substantially perpendicular to a longitudinal axis of the spanning beam which is secured at one point of one of the inner and outer extreme elements to one working cable winding on one winch disposed on the armoured vehicle, wherein in said transport position the spanning beam has a position lowered towards the ground and is retained in this lowered position by said working cable, the outer extreme element is supported by a support element of a mobile support device of the vehicle formed of a hollow blade similar to that of a bulldozer, said support device occupying a raised position, and said outer extreme element is pivotally maintained at its free end to the support element by locking means assembled to the support element, and the inner extreme element rests on the outer extreme element along the same;

the spanning beam can be raised through winding of the working cable on the winch into a raised position which is approximately vertical and where the inner extreme element is pivotally supported at its free end by the support element with concomitant release of the free end of the outer extreme element from the support element obtained by unlocking of the locking means when the free end of the inner extreme element is caused to rest on the support element;

the support device is then lowered towards a bearing position on the ground to cause the outer extreme element to move from the inner extreme element thus permitting the spreading of the beam; and the working cable is unwound from the winch to lower and deposit the spanning beam over the breach.

2. A system according to claim 1, wherein the free end of the inner extreme element is released from the support device through backward movement of the vehicle with respect to the spanning beam.

3. A system according to claim 1, wherein the locking means comprises a hook-forming part for holding to the support device an axis of the free end of the outer extreme element disposed transversally to the longitudinal axis of the spanning beam, and which can pivot with respect to the support element in the unlocking direction against the restoring force of a spring and a part, solid with the hook-forming part forming a pivoting arm for the hook-forming part, which arm is actuated by an axis of the free end of the inner extreme element, disposed transversally to the longitudinal axis of the spanning beam in the raised position of the spanning beam.

4. A system according to claim 1, wherein the support device comprises at least two parallel plates solid with said support element of said device, and a bearing part for the respective end axes of the inner and outer extreme elements, pivotally mounted between the two plates and which can co-operate alternately with two stops solid with the plates and limiting the range of pivoting of the bearing part between two extreme angular positions, one bearing position for the end axis of the outer extreme element in the transport position of the spanning beam and for the end axis of the inner extreme element in the raised and spreading positions of the spanning beam, and one release position for the end axis of the inner extreme element when the vehicle moves backwards.

5. A system according to claim 4, wherein the bearing part comprises two bearing recesses with round bottoms respectively for the two end axis of the inner and outer extreme elements, and the hook-forming part of the locking means co-operates with the bearing recess of the end axis of the outer extreme element and with a front edge of each of the parallel plates to lock said axis in the transport position of the spanning beam.

6. A system according to claim 5, wherein the locking means, made in one piece with the pivoting arm opposite to the hook-forming part, is pivotally mounted in the bearing part, and the pivoting arm of the locking means projects into the bearing recess of the end axis of the inner extreme element in the transport position of the spanning beam.

7. A system according to claim 5, wherein the front edges of the plates form with an inner nose-forming part a guiding path for the end axis of the end of the inner extreme element when said axis is released and when it is recovered towards the locking position.

8. A system according to claim 4, wherein the bearing part comprises at least one axis laterally projecting from said part and movable inside a bean-shaped oblong hole formed in at least one of the parallel plates, during the movement of the bearing part between the two extreme angular positions.

9. A system according to claim 8, wherein a resilient means, such as a draw spring, is fixed at its free ends respectively to the axis of the bearing part and to another axis solid with the plate.

10. A system according to claim 4, wherein the spring for drawing back the locking means is connected at its free ends respectively to a fixing point solid with said means and to another fixing point solid with the support part.

11. A system according to claim 1, further comprising a damping device disposed between the inner and outer extreme elements over the hinge axis of the two elements.

12. The system of claim 11, wherein the clamping device comprises an hydraulic jack.

13. A system according to claim 1 wherein, for the spreading of the spanning beam, the fixing point is solid with the outer extreme element and consists of a hook assembly mounted laterally in pivoting relationship on the outer extreme element and likely to co-operate alternately with two stops solid with said element, limiting the range of pivoting of the hook assembly between two extreme angular positions respectively of hooking of the working cable during the transport, the raising and the spreading of the spanning beam and of unhooking of one terminal of the cable from the hook by gravity once the spanning beam is deposited.

14. The system of claim 13, wherein said terminal is formed of a clevis.

15. A system according to claim 1, wherein at least one of the extreme elements or each of them includes near its hinge axis with the other extreme element a lateral arm solid with said extreme element and which is substantially parallel to the longitudinal axis of said extreme element beyond the common hinge axis of the two extreme elements.

16. A system according to claim 15, wherein the hook assembly is housed in each lateral arm and each arm includes an extreme part for guiding the working cable during the transport, the raising and the spreading of the spanning beam, the lateral arm co-operating with the cable during the spreading to form a lever arm about the hinge axis of the two extreme elements.

17. A system according to claim 1, comprising two pairs of parallel plates each of which including an assembly formed by a bearing part and a locking means and solid with the support element symmetrically to the longitudinal axis of the vehicle.

18. A system for spreading and depositing a spanning beam from a vehicle for clearing a breach, the spanning beam pivoting vertically and occupying a transport position on the vehicle and having two successive main elements, one inner extreme element and one outer extreme element folded down against the inner extreme element along the same, mounted in hinged relationship with respect to each other towards their adjacent ends through a hinge axis substantially perpendicular to a longitudinal axis of the spanning beam which is secured at one point of one of the inner and outer extreme elements to one working cable winding on one winch disposed on the armoured vehicle, wherein in said transport position the spanning beam has a position lowered towards the ground and is retained in this lowered position by said working cable, the outer extreme element is supported by a support element of a mobile support device of the vehicle formed of a hollow blade similar to that of a bulldozer, said support device occupying a raised position, and said outer extreme element is pivotally maintained at its free end to the support element by locking means assembled to the support element, and the inner extreme element rests on the outer extreme element along the same;

the spanning beam can be raised through winding of the working cable on the winch into a raised position which is approximately vertical and where the inner extreme element is pivotally supported at its free end by the support element with concomitant release of the free end of the outer extreme element from the support element obtained by unlocking of the locking means when the free end of the inner extreme element is caused to rest on the support element;

the support device is then lowered towards a bearing position on the ground to cause the outer extreme element to move from the inner extreme element thus permitting the spreading of the beam; and the working cable is unwound from the winch to lower and deposit the spanning beam over the breach; and wherein said locking means comprises a hook-forming part for holding to the support element an axis of the free end of the outer extreme element disposed transversally to the longitudinal axis of the spanning beam, and which can pivot with respect to the support element in the unlocking direction against the restoring force of a spring and a part, solid with the hook-forming part, forming a pivoting arm for the hook-forming part, which arm is actuated by an axis of the free end of the inner extreme element, disposed transversally to the longitudinal axis of the spanning beam in the raised position of the spanning beam.

* * * * *